US008517348B2

(12) United States Patent
Smith

(10) Patent No.: US 8,517,348 B2
(45) Date of Patent: Aug. 27, 2013

(54) WINDLASS SYSTEM AND METHOD

(76) Inventor: Frederick L. Smith, Park Ridge, NJ (US)

( * ) Notice: Subject to any disclaimer, the term of this patent is extended or adjusted under 35 U.S.C. 154(b) by 707 days.

(21) Appl. No.: 12/700,973

(22) Filed: Feb. 5, 2010

(65) Prior Publication Data

US 2011/0193037 A1 Aug. 11, 2011

(51) Int. Cl.
*B65H 27/00* (2006.01)
*B66D 3/00* (2006.01)
*B66D 1/38* (2006.01)

(52) U.S. Cl.
CPC ..... *B66D 1/38* (2013.01)
USPC ..... 254/385; 254/383; 242/397.3

(58) Field of Classification Search
USPC ..... 254/278, 335, 336, 383, 385; 242/397, 242/397.2, 397.3, 482.4, 482.8, 482.9
See application file for complete search history.

(56) References Cited

U.S. PATENT DOCUMENTS

| | | | | | |
|---|---|---|---|---|---|
| 41,171 | A | * | 1/1864 | Reynolds | 242/397.3 |
| 1,797,331 | A | * | 3/1931 | Dale | 242/397.3 |
| 3,024,001 | A | * | 3/1962 | Worden et al. | 254/331 |
| 3,202,372 | A | * | 8/1965 | Meline et al. | 242/386 |
| 3,670,977 | A | * | 6/1972 | Boneck | 242/397.3 |
| 3,788,605 | A | * | 1/1974 | Johnson | 254/361 |
| 3,885,656 | A | * | 5/1975 | Michling et al. | 192/225 |
| 4,151,981 | A | | 5/1979 | Gennep | |
| 4,328,954 | A | * | 5/1982 | Logus | 254/344 |
| 4,334,670 | A | * | 6/1982 | Kawabe | 254/346 |
| 4,529,171 | A | | 7/1985 | Woodruff | |
| 4,854,547 | A | * | 8/1989 | Oliphant | 254/271 |
| 5,098,068 | A | * | 3/1992 | Jussila | 254/342 |
| 5,255,895 | A | * | 10/1993 | Jussilla | 254/344 |
| 6,126,143 | A | * | 10/2000 | Fukunaga et al. | 254/344 |
| 6,443,431 | B1 | | 9/2002 | Stasny et al. | |
| 6,520,485 | B1 | | 2/2003 | Soot | |

(Continued)

OTHER PUBLICATIONS

CRS Technologies, Inc., WinchMaster, Advertising Literature, published prior to Jan. 2001.

*Primary Examiner* — Emmanuel M Marcelo
*Assistant Examiner* — Justin Stefanon
(74) *Attorney, Agent, or Firm* — Arthur Jacob

(57) ABSTRACT

A compact windlass and a method of operating the windlass are disclosed for exerting a force upon a load along a selected direction of force. A drum is extended along a longitudinal axis of rotation and a line is engaged with a surface on the drum. The line is aligned with a line spooling direction transverse to the longitudinal axis of rotation for being spooled onto the drum by a line spooling mechanism located in close proximity with the surface of the drum and engaging the line at a line engagement location juxtaposed with the drum, in response to rotation of the drum in a spooling direction of rotation, and off of the drum in response to rotation of the drum in an unspooling direction of rotation. A load is coupled with the line, and the line is directed between the line spooling direction and a selected direction of force aligned along a load path extending essentially parallel with the longitudinal axis of rotation and placed closely adjacent the drum, as the line is spooled onto and off of the drum, so as to exert a force upon the load along the selected direction of force. The windlass can be oriented in substantially any selected direction so as to orient the direction of force in a corresponding direction, for exerting a force along the corresponding direction, such as a lifting force or a pulling force, upon the load.

6 Claims, 5 Drawing Sheets

(56) References Cited

U.S. PATENT DOCUMENTS

| | | | | |
|---|---|---|---|---|
| 7,658,370 | B2 * | 2/2010 | Rotzler et al. | 254/344 |
| 7,748,685 | B2 * | 7/2010 | Richards | 254/385 |
| 8,196,900 | B2 * | 6/2012 | Kempf | 254/385 |
| 2003/0001147 | A1 | 1/2003 | Kivinitty | |
| 2005/0087644 | A1 * | 4/2005 | Kim | 242/390.8 |
| 2010/0032509 | A1 * | 2/2010 | Cazzaro et al. | 242/397.3 |

* cited by examiner

WINDLASS SYSTEM AND METHOD

The present invention relates generally to windlass systems and pertains, more specifically, to a windlass system and method in which a compact windlass utilizes a wire rope for lifting or pulling a load along a selected direction.

Windlass systems are used to move loads in a variety of applications. Typical applications are found in industrial, commercial and entertainment venues where it is necessary to lift or pull relatively heavy items along selected directions. For example, in the presentation of a stage show in connection with an entertainment event it is necessary to lift curtains and backdrops, and to pull various stage sets and props or the like in different directions, quickly and efficiently with a stable system which will not occupy an inordinate amount of space.

The more prevalent windlass systems currently in use employ a rope, a chain, or another line which is connected to the item to be moved and is wound upon a drum to exert a moving force upon the item. The drum usually is mounted in a horizontal orientation and the line is spooled along the drum to distribute the line along the length of the drum as the line is wound upon the drum, thereby effecting a relatively smooth and even placement of the line on the drum as the moving force is applied to the item. However, as the line is spooled onto or off of the drum, the direction of the line and, consequently, the direction of the applied force, will vary slightly relative to the load, due to traverse of the line along the length of the drum. Such changes in direction can lead to tipping or swaying of the windlass itself, resulting in undesirable instability and potentially unsafe conditions.

In addition, the horizontal orientation of a current windlass places restrictions upon the length of the drum, and the length of the line used in connection with the drum, thus limiting the versatility of such a windlass with respect to available installation sites and the types of loads which can be accommodated. Suggestions for extending the available length of a line, while maintaining a drum of minimal length, have included applying a line in multiple layers along the drum; however, it has been observed that upon spooling a line off successive layers above a base layer of line along a drum, there is a greater tendency toward undesirable twisting and jerking of the line as the line is drawn from a contiguous layer.

The present invention avoids the drawbacks outlined above and, as such, attains several objects and advantages, some of which are summarized as follows: Provides a windlass system and method in which a force is applied to a load along a selected one of a plurality of directions, utilizing a relatively compact windlass; enables a lifting or pulling force to be applied to a load by a windlass capable of being oriented so as to direct the force in virtually any selected direction with ease and stability; furnishes a windlass capable of being installed at a wide variety of sites, including sites where installation space is severely limited, to provide an effective moving force to a load; enables a smooth and accurately directed force to be applied to a load by a windlass of limited dimensions; allows the use of a line of extended length for applying a smooth lifting or pulling force to a load at sites having only limited space for the installation of a windlass; provides a windlass of relatively simple design and economical construction, capable of exemplary performance over an extended service life.

The above objects and advantages, as well as further objects and advantages, are attained by the present invention which may be described briefly as a compact windlass for exerting a force upon a load along a selected direction of force, the windlass comprising: a drum extending along a longitudinal axis of rotation and having a peripheral surface for rotation about the longitudinal axis of rotation; a line engaged with the peripheral surface of the drum and extending in a line spooling direction transverse to the longitudinal axis of rotation for being spooled onto the drum in response to rotation of the drum in a spooling direction of rotation, and off of the drum in response to rotation of the drum in an unspooling direction of rotation; a drive mechanism coupled with the drum for rotating the drum selectively in either one of the spooling and unspooling directions of rotation; and a line spooling mechanism located closely adjacent the drum and coupled with the drive mechanism for movement in spooling and unspooling directions extending substantially parallel with the longitudinal axis of rotation, in synchronism with rotation of the drum in respective spooling and unspooling directions of rotation, the line spooling mechanism being engaged with the line at a line engagement location placed in juxtaposition with the peripheral surface of the drum along a line path of travel extending from the engagement location along the line spooling direction to alignment with a load path extending substantially parallel with the longitudinal axis of rotation and spaced from the drum in the direction transverse to the longitudinal axis of rotation for directing the line between the line spooling direction and a selected direction of force substantially aligned with the load path for exerting a force upon the load along the load path, in the selected direction of force as the line is spooled onto and off of the drum.

In addition, the present invention provides a method of operating a compact windlass for exerting a force upon a load along a selected direction of force, the method comprising: providing a drum extending along a longitudinal axis of rotation and having a peripheral surface for rotation about the longitudinal axis of rotation; engaging a line with the peripheral surface of the drum and extending the line in a line spooling direction transverse to the longitudinal axis of rotation for being spooled onto the drum in response to rotation of the drum in a spooling direction of rotation, and off of the drum in response to rotation of the drum in an unspooling direction of rotation; rotating the drum selectively in either one of the spooling and unspooling directions of rotation; coupling the line with the load; and engaging the line with a line spooling mechanism at an engagement location placed in juxtaposition with the peripheral surface of the drum along a line path of travel extending along the line spooling direction to alignment with a load path extending substantially parallel with the longitudinal axis of rotation and spaced from the drum in the direction transverse to the longitudinal axis of rotation, closely adjacent the peripheral surface of the drum, to direct the line between the line spooling direction and a selected direction aligned with the load path as the line is spooled onto and off of the drum, so as to exert a force upon the load along the load path, in the selected direction of force, as the line is spooled onto and off of the drum.

The invention will be understood more fully, while still further objects and advantages will become apparent, in the following detailed description of preferred embodiments of the invention illustrated in the accompanying drawing, in which.

Figure 1:
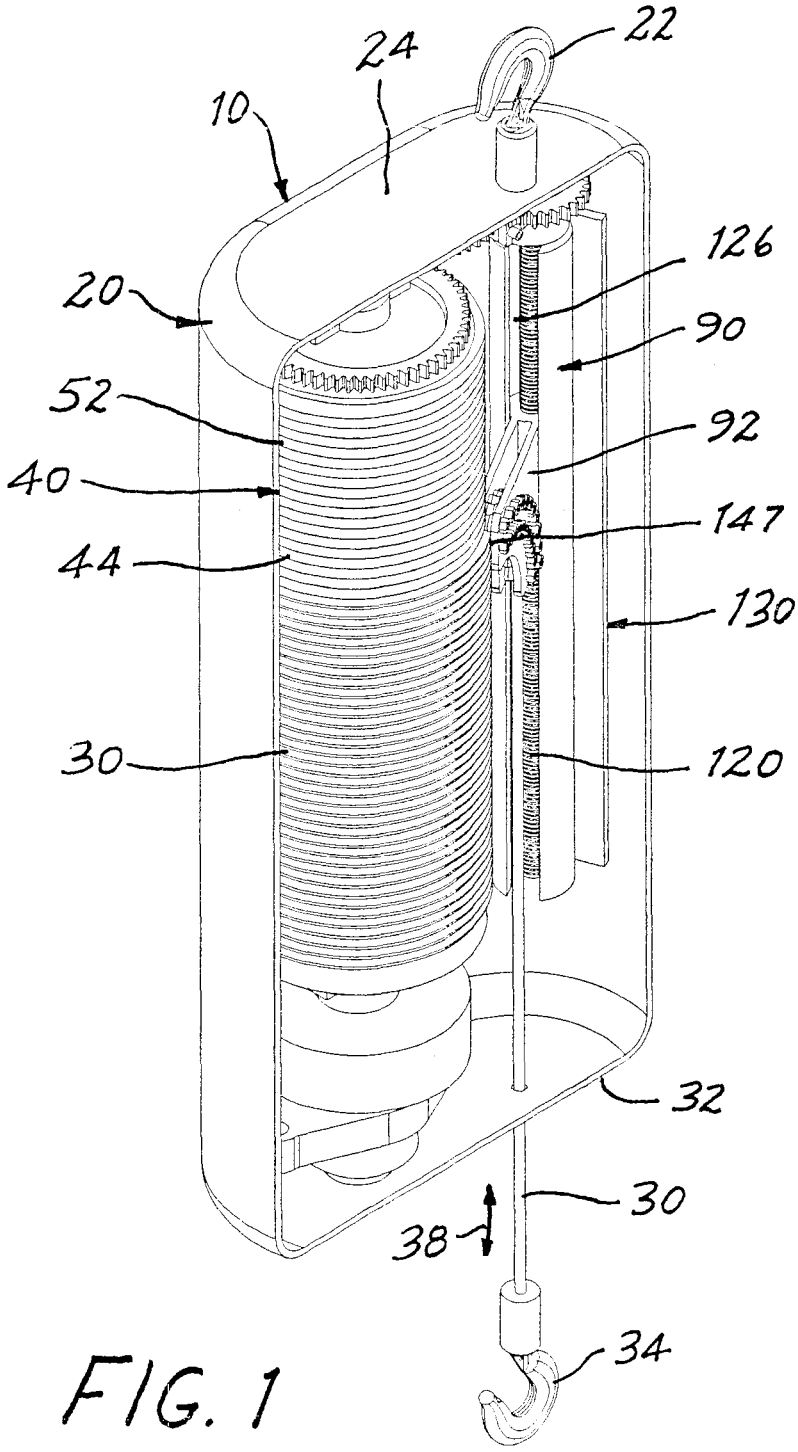
FIG. 1 is a pictorial view of a windlass constructed in accordance with the present invention, with portions broken away to show internal details of construction.
Figure 2:
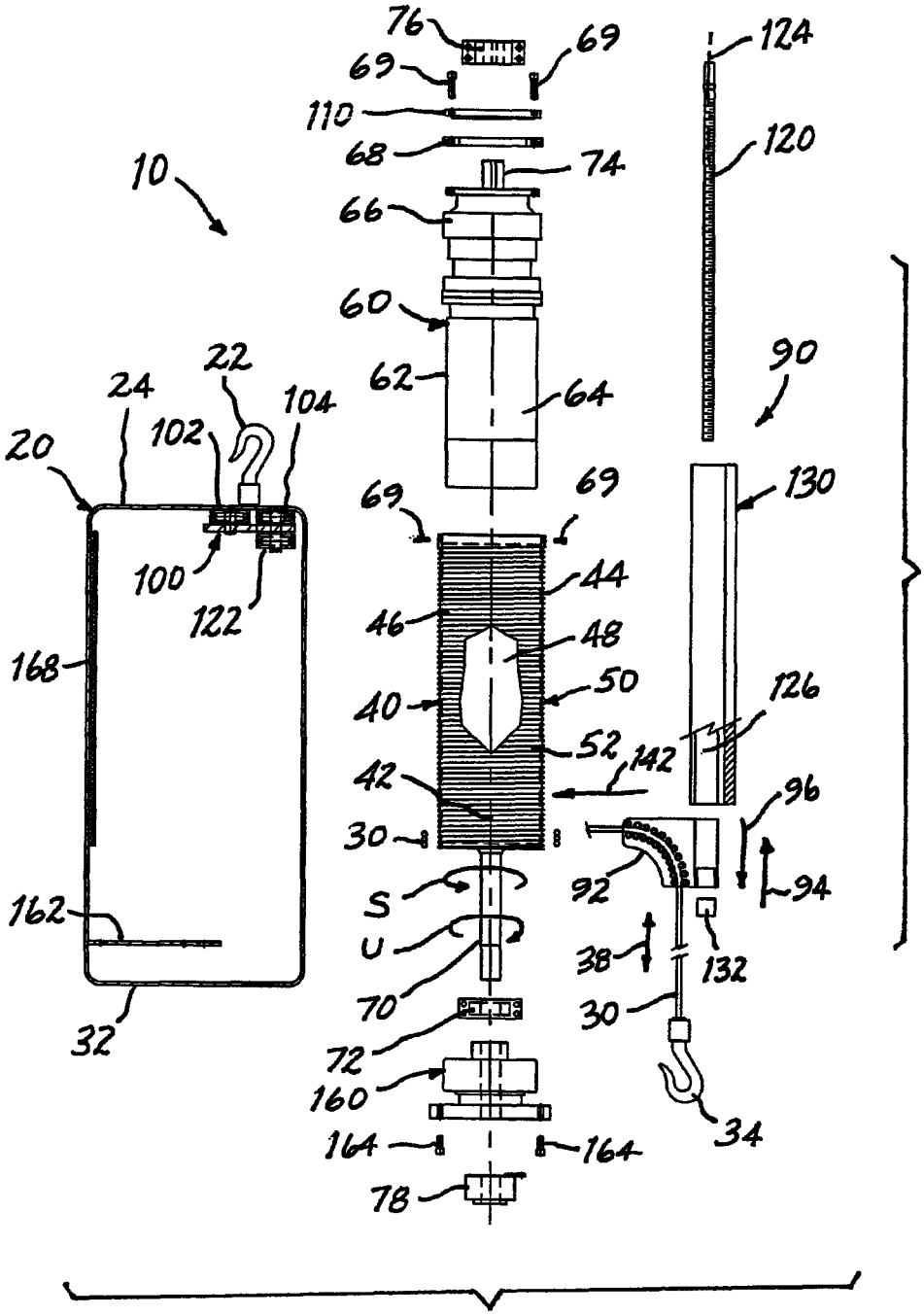
FIG. 2 is an exploded view illustrating component parts of the windlass.
Figure 4:
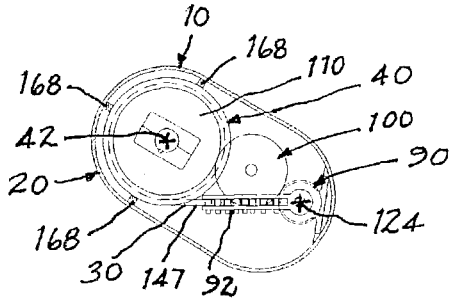
FIG. 4 is a somewhat diagrammatic, lateral cross-sectional view taken along line 4-4 of FIG. 3.
Figure 3:
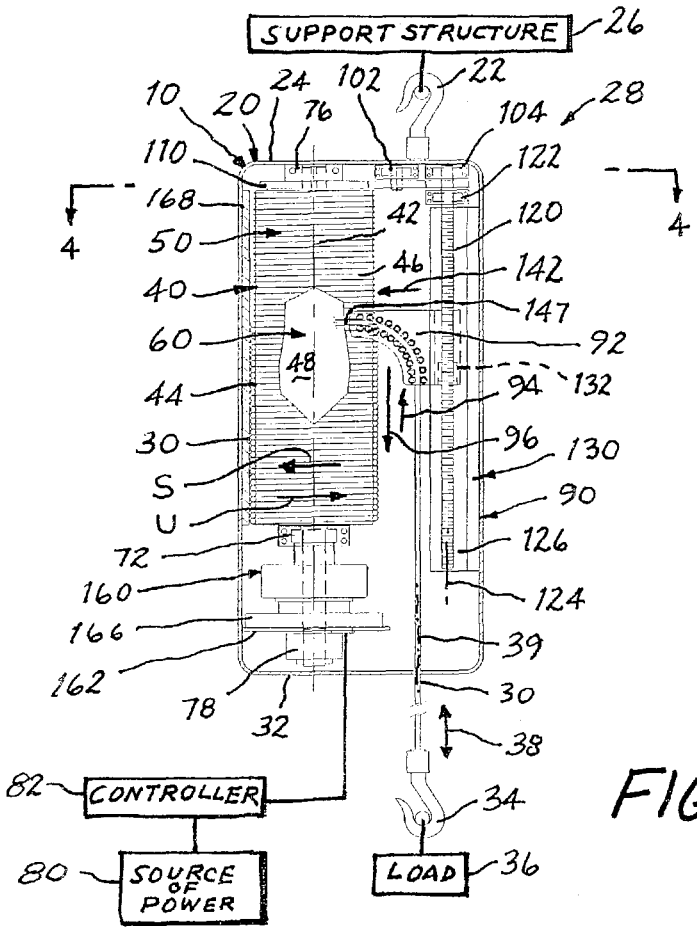
FIG. 3 is a longitudinal cross-sectional view of the windlass, showing component parts assembled.
Figure 5:
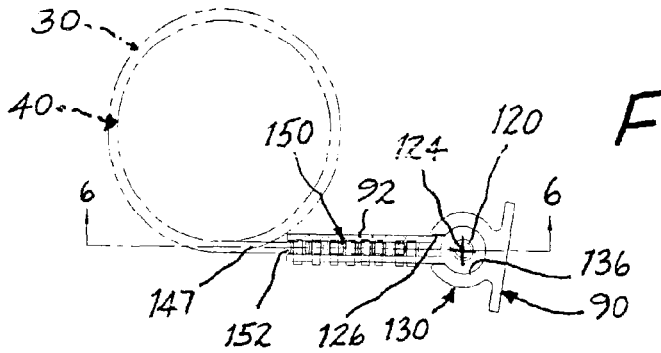
FIG. 5 is an enlarged, fragmentary plan view illustrating certain component parts of the windlass.
Figure 6:
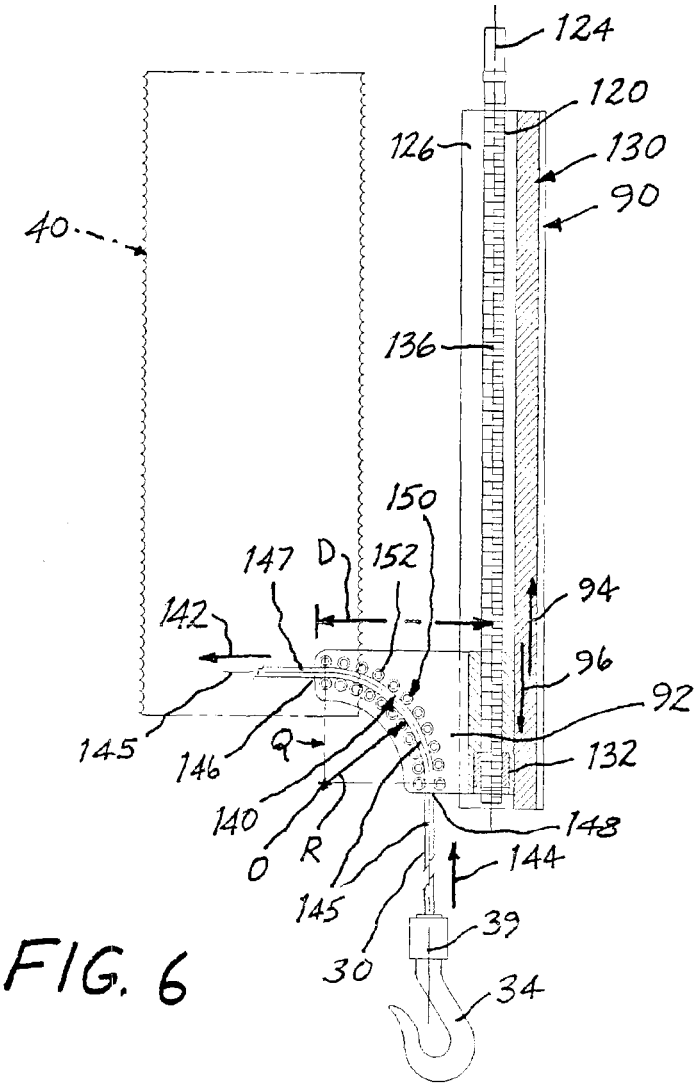
FIG. 6 is a longitudinal cross-sectional view taken along line 6-6 of FIG. 5.

Referring now to the drawing, and especially to FIG. 1 thereof, a windlass constructed in accordance with the present invention is shown at 10 and is seen to include a frame in the form of a housing 20 having a mounting member in the form of a first hook 22 secured to the windlass 10 at the upper end 24 of the housing 20 for suspending the windlass 10 from a building structure or the like, shown diagrammatically at 26 in FIG. 3, at an installation site 28, in a now-conventional manner. A line shown in the form of a wire rope 30 extends through lower end 32 of the housing 20 and carries a coupling member in the form of a second hook 34 provided for engaging a load, shown diagrammatically at 36 in FIG. 3, to be lifted or lowered along vertical directions indicated by arrow 38. As is known in the construction of windlasses, first hook 22 and second hook 34 are aligned along a common load path 39.

With further reference to FIGS. 2 through 6, as well as to FIG. 1, a drum 40 is mounted for rotation within housing 20 and extends along a longitudinal axis of rotation 42. Drum 40 includes a cylindrical member 44 having an exterior 46 and an interior 48. A peripheral surface 50 extends along the exterior 46 of the drum 40 and preferably includes a helical groove 52 having a cross-sectional configuration complementary to that of wire rope 30. Wire rope 30 is engaged with the peripheral surface 50 such that upon rotation of drum 40 about the axis of rotation 42 in a spooling direction of rotation S, wire rope 30 is wound onto the drum 40, and upon rotation of drum 40 about the axis of rotation 42 in an unspooling direction of rotation U, wire rope 30 is drawn off drum 40, as will be described more fully below.

A drive mechanism 60 is coupled with the drum 40 for rotating the drum 40 selectively in either one of the opposite spooling and unspooling directions of rotation S and U. Drive mechanism 60 includes a drive motor, shown in the form of an electric motor 62 having a motor case 64, and a gear drive 66 secured to the motor case 64. Drive mechanism 60 extends into the interior 48 of the drum 40 such that at least a major portion of the motor 62 is contained within the interior 48 of drum 40, rendering the assembled drum 40 and drive mechanism 60 compact. A connector ring 68 affixes the gear drive 66, and hence the motor case 64, to the drum 40, as with bolts 69, so that the motor case 64, the gear drive 66 and the drum 40 will rotate as a unit, along with a lower shaft 70 which depends from the lower end of the drum 40, is integrated with the drum 40, as by welding lower shaft 70 to the lower end of the drum 40, and is supported within a lower bearing block 72 affixed to housing 20 adjacent lower end 32 of housing 20. Alternately, the cylindrical member 44 and the motor case 64 may be in the form of a unitary member, thereby simplifying the design and construction of windlass 10.

An upper shaft 74 extends upwardly from gear drive 66 and is fixed against rotation relative to housing 20 by an upper bracket 76 secured to housing 20 at the upper end 24 of the housing 20 and engaged with upper shaft 74 to preclude rotation of upper shaft 74 relative to housing 20. A commutator 78 is carried by lower shaft 70 for conducting electrical power to motor 62 from an external source of power, shown schematically at 80 in FIG. 3. Thus, upon supplying electrical power to the motor 62, motor 62, gear drive 66 and drum 40 will rotate as a unit about axis of rotation 42, while upper shaft 74 is fixed against rotation, the direction of rotation of drum 40 being selected by a controller 82 in a manner well-known in windlass systems.

A line spooling mechanism 90 is located within housing 20, placed closely adjacent drum 40, and includes a carriage 92 coupled with drive mechanism 60 for selective movement in a spooling direction 94 or in an unspooling direction 96. Thus, a gear train 100 is mounted within housing 20 by upper bearing blocks 102 and 104 affixed to housing 20 at upper end 24, and is engaged between a ring gear 110 secured to connector ring 68, by bolts 69, for rotation with the connector ring 68, and a lead screw 120 which itself is mounted within housing 20 by another bearing block 122 for rotation about a further axis of rotation 124 extending substantially parallel to longitudinal axis of rotation 42 and located closely adjacent drum 40.

A guideway 130 is mounted within housing 20 and extends generally parallel to axis of rotation 124 to provide a channel 126 within which carriage 92 is engaged for sliding movement in the spooling and unspooling directions 94 and 96. Carriage 92 includes a follower 132 engaged with lead screw 120 so that carriage 92 is coupled with drive mechanism 60 and, consequently, with drum 40 for movement along a selected one of corresponding opposite linear spooling and unspooling directions 94 and 96 in response to and in synchronism with rotation of the drum 40. The placement of lead screw 120 and follower 132 within guideway 130 provides an accurately located and steady track 136 along which carriage 92 translates in the spooling and unspooling directions 94 and 96, while enabling axis of rotation 124 to be placed in close proximity with load path 39, with the carriage 92 extending in a direction transverse to the axis of rotation 124, between the axis of rotation 124 and the drum 40, and, in the preferred arrangement, the load path 39 is placed between the axis of rotation 124 and the drum 40,for balanced operation and compact dimensions.

Carriage 92 includes a passage 140 for engaging wire rope 30 and directing wire rope 30 between a line spooling direction 142, extending transverse to the longitudinal axis of rotation 42 of drum 40, and a direction of force, indicated by arrow 144, extending substantially parallel with the axis of rotation 42, closely adjacent the peripheral surface 50 of drum 40. Passage 140 establishes a line path of travel 145 which provides a smooth transition between a first end 146 of the passage 140, where the path of travel 145 is aligned substantially with line spooling direction 142 and the wire rope 30 is engaged by the carriage 92 at an engagement location 147 placed in very close proximity with the peripheral surface 50 of drum 40, by virtue of the placement of the carriage 92 between the lead screw 120 and the drum, and a second end 148 of the passage 140, where the path of travel 145 is aligned substantially with the load path 39 to establish the direction of force 144. Upon rotation of drum 40 in the spooling direction of rotation S, wire rope 30 will be spooled onto the peripheral surface 50 of the drum 40, guided by the carriage 92, moving in synchronism with rotation of the drum 40, into a single layer along the peripheral surface 50, assisted by the helical groove 52 in maintaining a consistent, even and compact layer along the length of the drum 40, and a force will be exerted upon the load 36 along the direction of force 144 to lift the load 36. Upon rotation of the drum 40 in the unspooling direction of rotation U, opposite to the spooling direction of rotation S, wire rope 30 will be spooled off of the peripheral surface 50 of the drum 40 to lower the load 36.

In the illustrated embodiment, the path of travel 145 follows an arcuate configuration, preferably extending along a quadrant Q having a radius R extending from an origin O so that path of travel 145 turns through 90°, with the path of travel 145 at the second end 148 of passage 140 directed substantially perpendicular to the direction of the path of travel 145 at the first end 146 of passage 140, and the direction of force 144 extending along the load path 39, substantially parallel with the axis of rotation 42, closely adjacent the axis of rotation 42, during both spooling and unspooling. At the same time, the path of travel 145 at the first end 146 of passage 140 is directed substantially perpendicular to the axis of rotation 42 such that the wire rope 30 is guided to and from the peripheral surface 50 of the drum 40 at a substantially zero fleet angle, assuring a smooth operation, free of discontinuities such as jumps and jerks in the wire rope 30. The arcuate configuration of the path of travel 145, preferably extending along the quadrant Q with the origin O of radius R in close proximity with drum 40, provides carriage 92 with a relatively short transverse dimension D, enabling the first end 146 of passage 140, and engagement location 147, to be placed in juxtaposition with the peripheral surface 50 of drum 40, thereby enhancing the accuracy with which wire rope 30 is directed onto the drum 40 and into helical groove 52, while reducing the transverse distance between drum 40 and load path 39 for better balance and for rendering windlass 10 more compact. Preferably, wire rope 30 is of the type constructed to resist rotation so that twisting movements are deterred, thereby maintaining smoothness of operation, adherence to a consistent, accurate direction of force, and concomitant increased safety. Further, channel 126 along guideway 130 confines the carriage 92 to movement along an accurately defined linear path of travel as the carriage 92 moves along each of the spooling and unspooling directions 94 and 96, thereby promoting precision during placement of the wire rope 30 on the drum 40 and during withdrawal of the wire rope 30 from the drum 40, as well as the accurate determination of the direction of force 144.

In order to facilitate smooth movement of wire rope 30 through passage 140, and to promote stability, as carriage 92 translates along either spooling direction 94 or opposite unspooling direction 96, a plurality of bearing members 150 are placed along the passage 140, juxtaposed with the path of travel 145 for engaging wire rope 30 as the wire rope 30 moves along path of travel 145 through the passage 140. Bearing members 150 preferably are in the form of rollers 152 mounted upon carriage 92 for rotation about corresponding axes perpendicular to the direction of travel of wire rope 30 along passage 140 and having a sheave-like configuration for rolling in response to engagement by the wire rope 30 while confining the wire rope 30 to the prescribed path of travel 145 through passage 140.

A braking mechanism 160 is mounted upon a plate 162 integral with housing 20, as by screws 164 which pass through a mounting base 166 to engage plate 162. Lower shaft 70 extends through braking mechanism 160, and braking mechanism 160 is actuated selectively to secure drum 40 against rotation relative to housing 20 when a desired length of wire rope 30 is spooled onto or off of drum 40. Pads 168 are affixed to the housing 20, spaced circumferentially around the interior of the housing 20, interposed between the housing 20 and the turns of wire rope 30 on the drum 40, for assisting in maintaining wire rope 30 in place around the peripheral surface 50 of the drum 40.

The arrangement wherein the carriage 92 translates along linear paths of travel substantially parallel with the axis of rotation 42 of drum 40, closely adjacent the peripheral surface 50 of the drum 40, and along a length corresponding to the axial length of the drum 40, while spooling and unspooling the wire rope 30, and directing the wire rope 30 along a direction of force 144 aligned with load path 39, substantially parallel with the axis of rotation 42, closely adjacent the drum 40, provides a compact construction for windlass 10, enabling enhanced versatility with respect to capacity and balance, and smooth operation for greater ease of use and increased safety.

Figure 7:
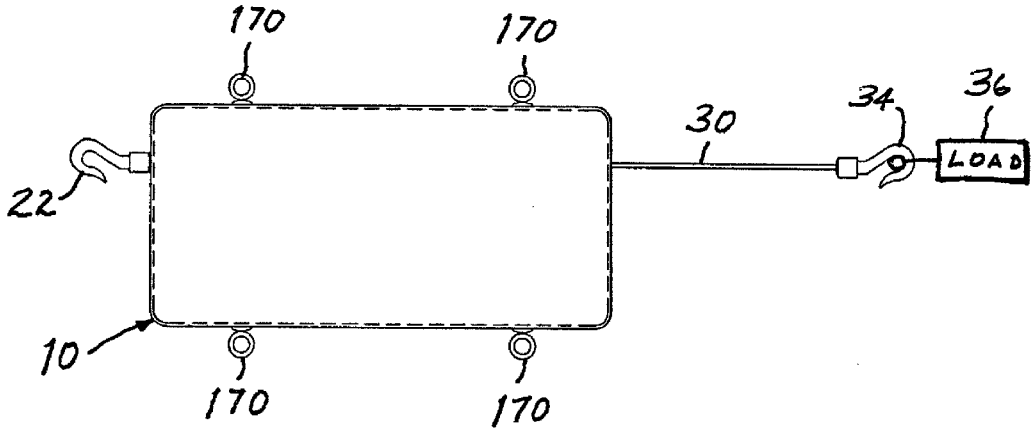
FIG. 7 is an elevational view showing an alternate construction.

Turning now to FIG. 7, the increased versatility of the construction of windlass 10 is demonstrated by the provision of additional or alternate mounting members, shown in the form of eye screws 170 placed at one or more selected locations, as illustrated, which selected locations enable mounting of the windlass 10 in a variety of selectable orientations to direct a force along any one of various selectable directions. Thus, while hook 22 enables windlass 10 to be suspended from a support structure 26 in a vertical orientation, as illustrated in FIGS. 1 through 6, for exerting a vertically directed lifting force upon a load 36, alternate eye screws 170 allow windlass 10 to be suspended from a variety of support structures (not shown) in a horizontal orientation, as illustrated in FIG. 7, for exerting a horizontally directed pulling force upon a load 36 with stability, balance and an accurate determination of the direction of force. Since the construction of windlass 10 enables operation as described above independent of mounting orientation, selectable orientations of windlass 10, other than purely vertical or purely horizontal, are available with the same safe and reliable performance.

It will be seen that the present invention attains all of the objects and advantages summarized above, namely: Provides a windlass system and method in which a force is applied to a load along a selected one of a plurality of directions, utilizing a relatively compact windlass; enables a lifting or pulling force to be applied to a load by a windlass capable of being oriented so as to direct the force in virtually any selected direction with ease and stability; furnishes a windlass capable of being installed at a wide variety of sites, including sites where installation space is severely limited, to provide an effective moving force to a load; enables a smooth and accurately directed force to be applied to a load by a windlass of limited dimensions; allows the use of a line of extended length for applying a smooth lifting or pulling force to a load at sites having only limited space for the installation of a windlass; provides a windlass of relatively simple design and economical construction, capable of exemplary performance over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A compact windlass for exerting a force upon a load along a selected direction of force, the windlass comprising:

a drum extending along a longitudinal axis of rotation and having a peripheral surface for rotation about the longitudinal axis of rotation, the drum including a cylindrical member having an exterior and an interior, the peripheral surface extending along the exterior;

a line engaged with the peripheral surface of the drum and extending in a line spooling direction transverse to the longitudinal axis of rotation for being spooled onto the drum in response to rotation of the drum in a spooling direction of rotation, and off of the drum in response to rotation of the drum in an unspooling direction of rotation;

a drive mechanism coupled with the drum for rotating the drum selectively in either one of the spooling and unspooling directions of rotation, the drive mechanism including a motor and a gear drive, the motor and the gear drive of the drive mechanism being placed substantially entirely within the interior of the drum;

a frame, the drive mechanism being mounted upon the frame and integrated with the cylindrical member of the drum for rotation of the drum, the cylindrical member and the drive mechanism as a unit relative to and within the frame, thereby providing a compact arrangement of the drum and the drive mechanism within the frame;

a carriage located closely adjacent the drum and coupled with the drive mechanism for movement in spooling and unspooling directions extending substantially parallel with the longitudinal axis of rotation, in synchronism with rotation of the drum in respective spooling and unspooling directions of rotation, the carriage being engaged with the line at a line engagement location placed in close juxtaposition with the peripheral surface of the drum, along a line path of travel extending from the engagement location along the line spooling direction to alignment with a load path extending substantially parallel with the longitudinal axis of rotation and spaced from the drum in the direction transverse to the longitudinal axis of rotation for directing the line between the line spooling direction and the selected direction of force substantially aligned with the load path to exert a force upon the load along the load path, in the selected direction of force as the line is spooled onto and off of the drum;

a passage in the carriage for receiving the line from the line engagement location, directing the line along the line spooling direction, and further directing the line along the selected direction of force;

a lead screw coupled with the drive mechanism for rotation about a further axis of rotation, the carriage being coupled with the lead screw for movement in the spooling and unspooling directions in response to corresponding rotation of the lead screw about the further axis of rotation, the carriage extending in a direction transverse to the further axis of rotation, between the further axis of rotation and the drum, and the load path being placed between the further axis of rotation and the drum; and a guideway having a channel extending substantially parallel to the further axis of rotation, the channel extending along substantially the entire length of the peripheral surface of the drum, the further axis of rotation being located within the channel, the carriage being engaged within the channel for sliding movement along the guideway in the spooling and unspooling directions, while being constrained by the channel against rotation about the further axis of rotation such that the line is confined substantially to the line spooling direction as the line is moved to and from the peripheral surface of the drum throughout movement of the carriage in the spooling and unspooling directions, thereby assuring smooth operation and promoting a balanced operation while maintaining compact dimensions.

2. The windlass of claim 1 wherein the spooling and unspooling directions are linear directions extending opposite to one another.

3. The windlass of claim 1 wherein the exterior of the drum includes a helical groove for receiving the line spooled upon the peripheral surface of the drum.

4. The windlass of claim 1 wherein the passage has an arcuate configuration extending along a quadrant located in close proximity with the drum so as to place a first end of the passage at the line engagement location, in juxtaposition with the peripheral surface of the drum.

5. The windlass of claim 4 wherein the further axis of rotation of the lead screw is substantially parallel to the longitudinal axis of rotation of the drum.

6. A method of operating a compact windlass for exerting a force upon a load along a selected direction of force, the method comprising:

providing a drum extending along a longitudinal axis of rotation within a frame and having a peripheral surface for rotation about the longitudinal axis of rotation, the drum including a cylindrical member having an exterior and an interior, the peripheral surface extending along the exterior;

engaging a line with the peripheral surface of the drum and extending the line in a line spooling direction transverse to the longitudinal axis of rotation for being spooled onto the drum in response to rotation of the drum in a spooling direction of rotation, and off of the drum in response to rotation of the drum in an unspooling direction of rotation;

providing a drive mechanism including a motor and a gear drive;

placing the motor and the gear drive substantially entirely within the interior of the drum;

mounting the drive mechanism upon the frame;

integrating the drive mechanism with the cylindrical member of the drum for rotation of the drum and the drive mechanism as a unit relative to and within the frame;

rotating the drive mechanism and the drum selectively in either one of the spooling and unspooling directions of rotation relative to the frame;

coupling the line with the load;

locating a carriage closely adjacent the drum;

coupling the carriage with the drive mechanism for movement in spooling and unspooling directions extending substantially parallel with the longitudinal axis of rotation, in synchronism with rotation of the drum in respective spooling and unspooling directions of rotation;

engaging the carriage with the line at a line engagement location placed in close juxtaposition with the peripheral surface of the drum to receive the line within the carriage, from the line engagement location;

directing the line, within the carriage, along a line path of travel extending from the engagement location along the line spooling direction, and thence along the selected direction of force and into alignment with a load path extending substantially parallel with the longitudinal axis of rotation and spaced from the drum in the direction transverse to the longitudinal axis of rotation to exert a force upon the load along the load path, in the selected direction of force as the line is spooled onto and off of the drum;

coupling a lead screw with the drive mechanism for rotation of the lead screw about a further axis of rotation;

coupling the carriage with the lead screw for movement in the spooling and unspooling directions in response to corresponding rotation of the lead screw;

extending the carriage in a direction transverse to the further axis of rotation, between the further axis of rotation and the drum, and placing the load path between the further axis of rotation and the drum;

placing the carriage within a channel extending substantially parallel to the further axis of rotation along substantially the entire length of the peripheral surface of the drum, with the carriage slidable along the channel in the spooling and unspooling directions, along substantially the entire length of the peripheral surface of the drum; and locating the further axis of rotation within the channel, and constraining the carriage within the channel against rotation about the further axis of rotation so that the line is confined substantially to the line spooling direction as the line is moved to and from the peripheral surface of the drum throughout movement of the carriage in the spooling and unspooling directions, thereby assuring smooth operation and promoting a balanced operation while maintaining compact dimensions.

* * * * *